US009925823B1

(12) United States Patent
Fyffe

(10) Patent No.: US 9,925,823 B1
(45) Date of Patent: Mar. 27, 2018

(54) GLUE SPONGE SYSTEMS

(71) Applicant: Susan Fyffe, Commerce, GA (US)

(72) Inventor: Susan Fyffe, Commerce, GA (US)

( * ) Notice: Subject to any disclaimer, the term of this patent is extended or adjusted under 35 U.S.C. 154(b) by 0 days.

(21) Appl. No.: 15/175,845

(22) Filed: Jun. 7, 2016

(51) Int. Cl.
*B43M 11/06* (2006.01)
*B43M 11/04* (2006.01)
*B65D 47/42* (2006.01)

(52) U.S. Cl.
CPC ..... *B43M 11/04* (2013.01); *B43M 11/06* (2013.01); *B65D 47/42* (2013.01)

(58) Field of Classification Search
CPC ..... B43M 11/04; B43M 11/06; B65D 47/42
USPC ..... 401/196, 198
See application file for complete search history.

(56) References Cited

U.S. PATENT DOCUMENTS 1,018,592 A * 2/1912 Stacy ..... B41K 1/54 118/265
3,218,666 A 11/1965 Espey
3,797,946 A 3/1974 Witzmann et al.
5,148,951 A * 9/1992 Moure ..... A45D 40/0075 100/116
6,682,246 B2 1/2004 Reggiani
7,275,884 B2 10/2007 Sassouni
2004/0237433 A1* 12/2004 Smith ..... B44C 1/105 52/311.1
2013/0022387 A1* 1/2013 Purizhansky ..... A45D 34/04 401/262

FOREIGN PATENT DOCUMENTS

JP 2007021785 A * 2/2007

* cited by examiner

*Primary Examiner* — Jennifer C Chiang

(57) ABSTRACT

A glue sponge system including a glue sponge assembly with a glue-container, a sponge having a body including a plurality of holes, and a plurality of channels, and at least one glue. The glue sponge assembly is useful for controllably applying glue to surfaces and storing the glue for later use.

17 Claims, 4 Drawing Sheets

GLUE SPONGE SYSTEMS

BACKGROUND OF THE INVENTION

The following includes information that may be useful in understanding the present invention(s). It is not an admission that any of the information provided herein is prior art, or material, to the presently described or claimed inventions, or that any publication or document that is specifically or implicitly referenced is prior art.

1. Field of the Invention

The present invention relates generally to the field of glue and adhesive application means and more specifically relates to glue sponge systems.

2. Description of Related Art

Adhesives such as glue are substances applied to one surface, or both surfaces, of two separate items that binds them together and resists their separation. The use of adhesives offers many advantages over binding techniques such as sewing, mechanical fastening, thermal bonding, and the like. These include the ability to bind different materials together, to distribute stress more efficiently across the joint, the cost effectiveness of an easily mechanized process, an improvement in aesthetic design, and increased design flexibility.

Disadvantages of adhesive use include decreased stability at high temperatures, relative weakness in bonding large objects with a small bonding surface area, and greater difficulty in separating objects during testing. Adhesives are typically organized by the method of adhesion. These are then organized into reactive and non-reactive adhesives, which refers to whether the adhesive chemically reacts in order to harden. Alternatively they can be organized by whether the raw stock is of natural or synthetic origin, or by their starting physical phase. Adhesives may be found naturally or produced synthetically. Individuals may use adhesives such as glue for various projects that it is desirable that items be affixed to one another. Many times glues may dry in advance of use rendering it useless or an excess of glue may be applied which is not desirable. A suitable solution is desired.

Several attempts have been made to solve the above-mentioned problems such as those found in U.S. Patent and U.S. Publication numbers: U.S. Pat. Nos. 7,275,884; 3,797,946; 6,682,246; and 3,218,666. This art is representative of glue and adhesive application means. However, none of the above inventions and patents, taken either singly or in combination, is seen to describe the invention as claimed.

Preferably, a glue sponge system should provide an efficient means for distributing a desired amount of adhesive product on at least one surface and, yet would operate reliably and be manufactured at a modest expense. Thus, a need exists for a reliable glue sponge system to avoid the above-mentioned problems.

BRIEF SUMMARY OF THE INVENTION

In view of the foregoing disadvantages inherent in the known glue and adhesive application means art, the present invention provides a novel glue sponge system. The general purpose of the present invention, which will be described subsequently in greater detail is to provide an efficient means for applying adhesives such as glue to a surface.

A glue sponge system is disclosed herein, in a preferred embodiment, comprising: a glue sponge assembly including a glue-container, a sponge having a body including a plurality of holes, and a plurality of channels, and at least one glue; wherein the glue sponge system comprises the glue sponge assembly.

The glue sponge assembly comprises the glue-container, the sponge, and the at least one glue in functional combination for use. The sponge comprises the body having the plurality of holes, and the plurality of channels; wherein the at least one glue is removably contained within confines of the glue-container, the sponge is insertable into contact with the at least one glue such that the at least one glue is able to be applied to a surface (such as a back of a piece of paper for example or other such surface); the at least one glue carried from the glue-container via the sponge; the sponge able to carry the at least one glue via filling the plurality of holes, and the plurality of channels. When the sponge is manipulated it can dispense the glue as it is 'squeezed out'. The glue is able to be controllably dispensed onto the surface via pressure application upon the sponge by a user. The sponge is flexible and porous, and may comprise polyurethane in preferred embodiments. Excess glue is returned to the container via gravity. The sponge does not comprise a pad.

The glue-container comprises a lid and at least one hinge; wherein the lid is hinged in relation to the glue-container such that the glue-container is able to be opened to access the at least one glue. The lid is hinged in relation to the glue-container such that the glue-container is able to be closed to restrict access or alternately able to be opened to access the sponge and the at least one glue. The sponge is able to be immersed in the at least one glue for an extended duration the at least one glue being isolated from an ambient-drying environment when the lid is closed which may also resist molding and pre-mature hardening of the at least one glue. The plurality of holes, and the plurality of channels are inter-connected to allow passage of the at least one glue in and out of the body of the sponge. The body of the sponge is preferably soft and deformable such that it is easy to manipulate during use. In this way, the glue is able to be controllably reabsorbed via touch-contact (and wicking) into the plurality of holes, and the plurality of channels as the pressure application upon the sponge by the user is released such that excess at least one glue is not left on the surface. The sponge isn't removed out of the box to apply the glue. The user presses the material onto the sponge in the box. Most glue applicators go from applicator to material. The present invention goes from material onto the applicator. This is how it controls the amount of glue. The sponge reabsorbs the glue using gravity.

A kit is also disclosed herein including: the glue-container, the sponge, the at least one glue, and a set of user-instructions.

The present invention holds significant improvements and serves as a glue sponge system. For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present invention, glue sponge system, constructed and operative according to the teachings of the present invention.

The various embodiments of the present invention will hereinafter be described in conjunction with the appended drawings, wherein like designations denote like elements.

DETAILED DESCRIPTION

Figure 1:
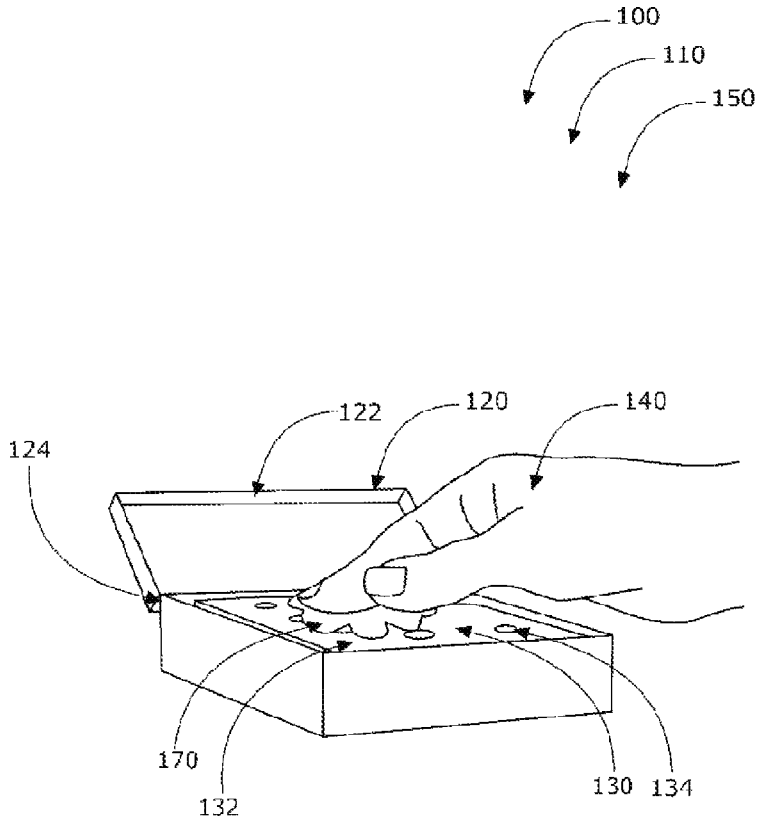
FIG. 1 shows a perspective view illustrating a glue sponge system comprising a glue sponge assembly during an 'in-use' condition showing a user applying glue (adhesive) to a surface (such as a piece of paper) according to an embodiment of the present invention.

As discussed above, embodiments of the present invention relate to a glue and adhesive application means and more particularly to a glue sponge system as used to improve the efficient application of glue and other adhesives.

Referring to the drawings by numerals of reference there is shown in FIGS. 1-4, various views of glue sponge system 100 comprising glue sponge assembly 110 including glue-container 120, sponge 130 (having body 132 including plurality of holes 134, and a plurality of channels 136), and at least one glue 160; wherein glue sponge system 100 comprises glue sponge assembly 110, as shown in 'in-use' condition 150. Glue sponge assembly 110 comprises glue-container 120, sponge 130, and the at least one glue 160 in functional combination for use.

Sponge 130 comprises body 132 having plurality of holes 134, and plurality of channels 136. At least one glue 160 is removably contained within confines of glue-container 120. Sponge 130 is insertable into contact with the at least one glue 160 (via dipping, immersing or the like) such that the at least one glue 160 is able to be applied to at least one surface 170; the at least one glue 160 carried from glue-container 120 via sponge 130; sponge 130 able to carry at least one glue 160 via filling plurality of holes 134, and plurality of channels 136. In this way, glue 160 is able to be controllably dispensed onto surface 170 via pressure application upon sponge 130 by a user 140 as shown in FIG. 1. Glue 160 is also able to be controllably reabsorbed (wicking effect when contacting the glue 160) via touch-contact and gravity into the plurality of holes 134 and the plurality of channels 136 as pressure application upon sponge 130 by user 140 is released such that excess at least one glue 160 is not left on the surface 170. This is desirable to minimize waste and mess.

Figure 2:
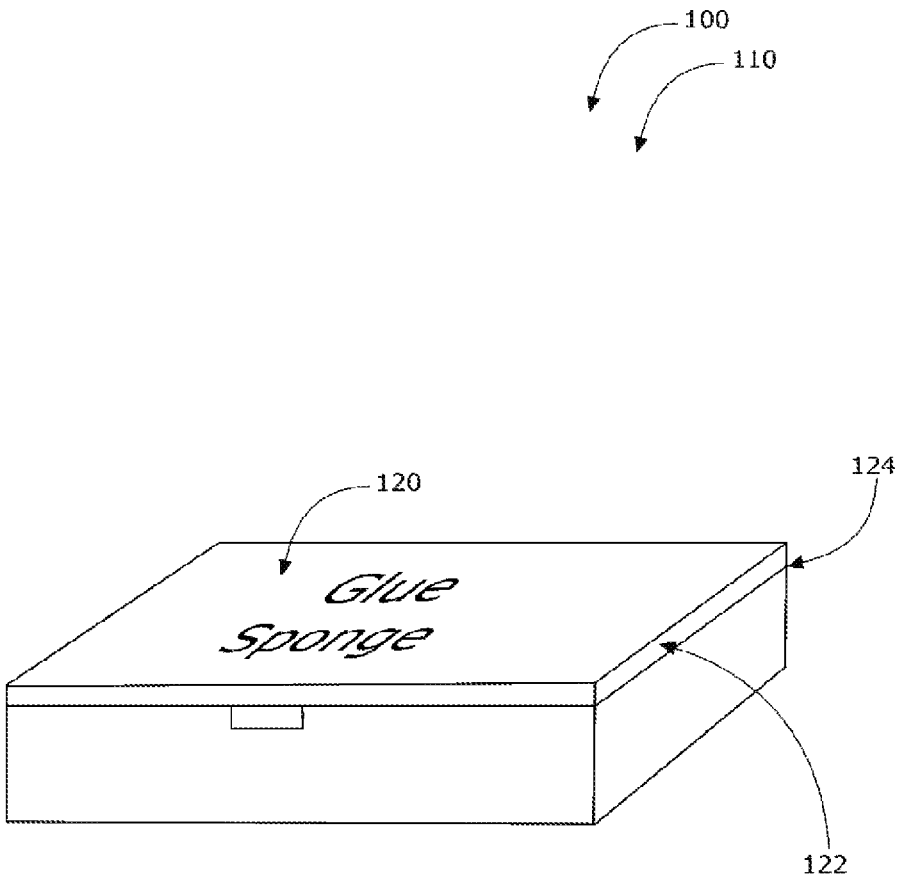
FIG. 2 is a perspective view illustrating the glue sponge assembly according to an embodiment of the present invention of FIG. 1.
Figure 3:
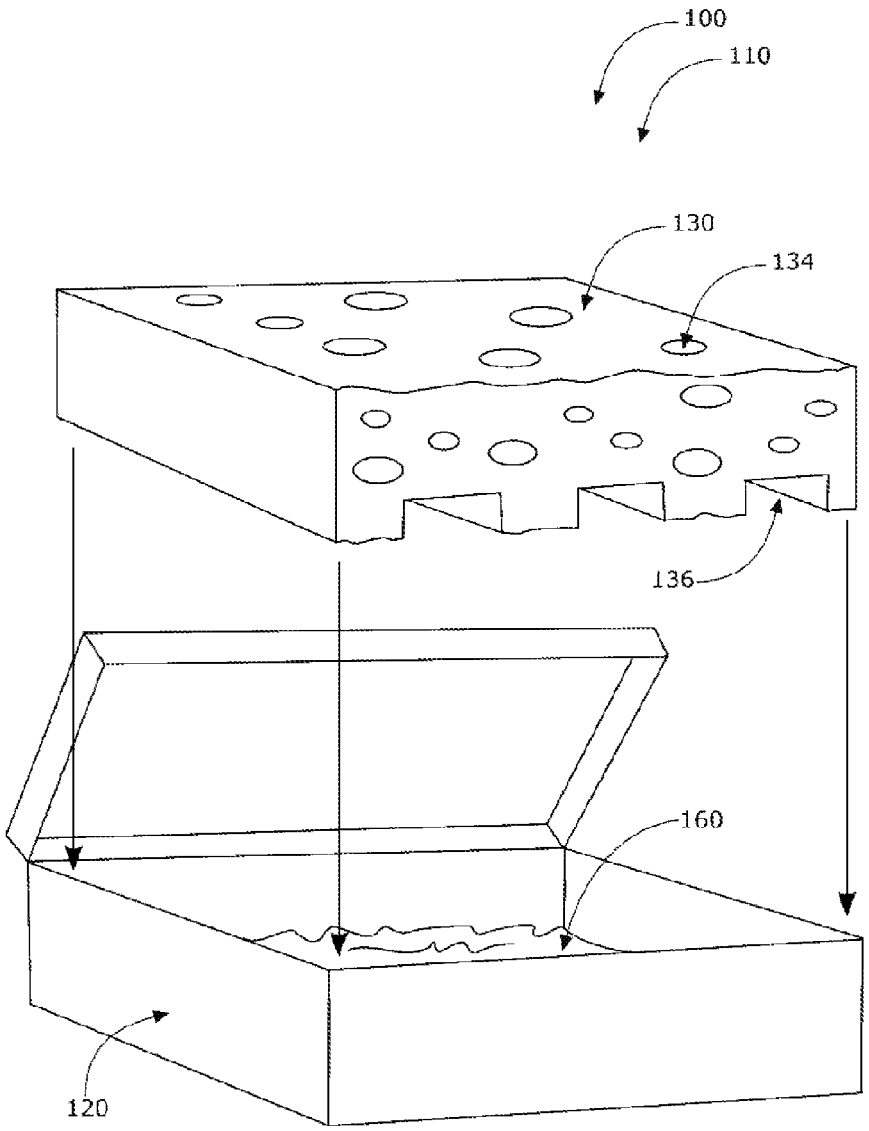
FIG. 3 is an exploded view illustrating the glue sponge assembly having glue-container (in an open condition with a lid raised), a sponge, and at least one glue according to an embodiment of the present invention.
Figure 4:
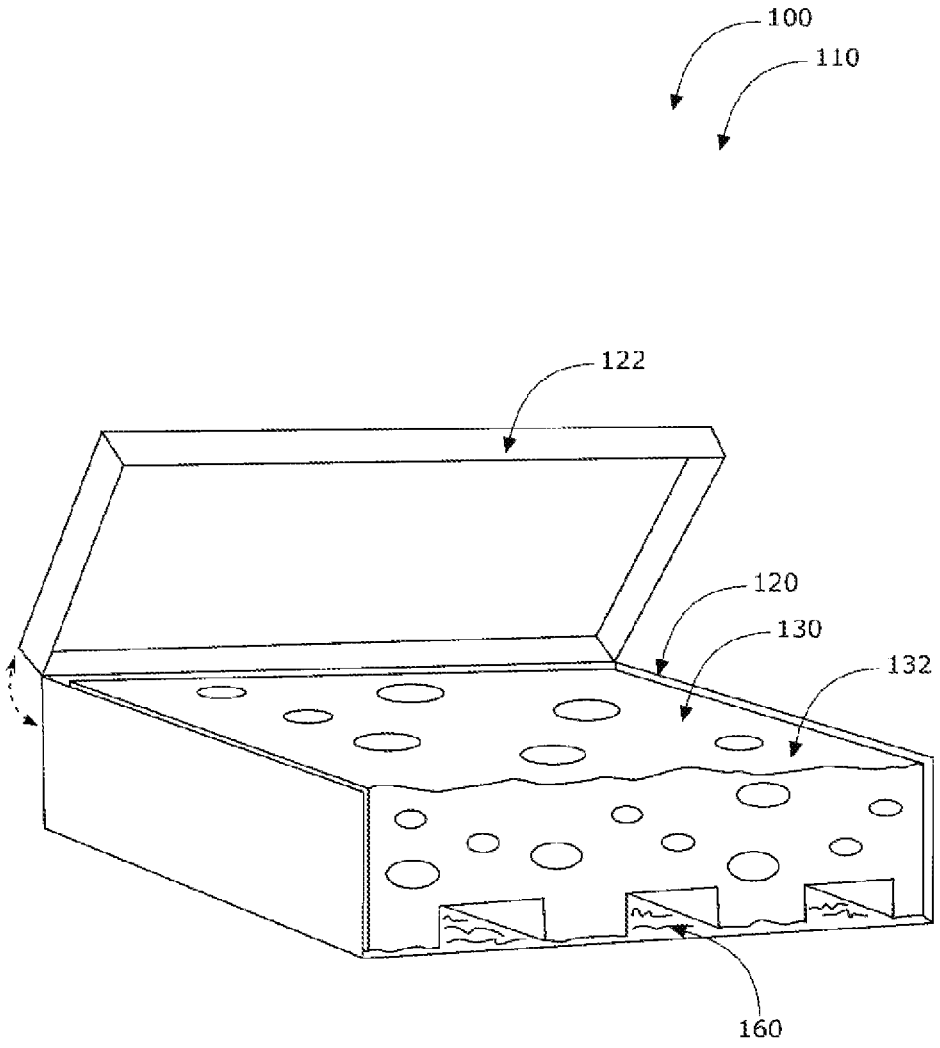
FIG. 4 is another perspective view illustrating the glue sponge assembly according to an embodiment of the present invention of FIG. 1.

Sponge 130 is preferably flexible and porous. Sponge 130 preferably comprises polyurethane however may comprise other suitably equivalent materials. Referring now to glue-container 120; glue-container 120 comprises lid 122. Glue-container 120 comprises at least one hinge 124. Lid 122 is hinged in relation to glue-container 120 such that glue-container 120 is able to be opened to access the at least one glue 160 as shown in FIGS. 1 and 3. Lid 122 is hinged in relation to glue-container 120 such that glue-container 120 is able to be closed to restrict access the at least one glue 160 as shown in FIG. 2. Other embodiments may have screw on lids or fit-lids or the like. Lid 122 is hinged in relation to glue-container 120 such that glue-container 120 is able to be opened to access sponge 130 and the at least one glue 160 as shown in FIG. 1.

Lid 122 is hinged in relation to glue-container 120 such that glue-container 120 is able to be closed to restrict access to sponge 130 and the at least one glue 160. Sponge 130 is able to be immersed in the at least one glue 160 for an extended duration (when stored between uses) that at least one glue 160 being isolated from an ambient-drying environment when lid 122 is closed. Sponge 130 does not comprise a pad. Glue-container 120 with lid 122 closed resists molding of the at least one glue 160. Further, glue-container 120 with lid 122 closed resists pre-mature hardening of at least one glue 160.

Plurality of holes 134, and plurality of channels 136 are inter-connected to allow passage of the at least one glue 160 in and out of body 132 of sponge 130. Glue-container 120 preferably comprises plastic such that glue-container 120 does not react negatively with the at least one glue 160. Glue-container 120 may comprise alternate materials. Body 132 of sponge 130 is soft and deformable.

It should be noted that glue sponge system 100 may be sold as kit comprising the following parts: at least one glue-container 120 at least one sponge 130; at least one at least one glue 160; and at least one set of user instructions. The kit has instructions such that functional relationships are detailed in relation to the structure of the invention (such that the invention can be used, maintained, or the like in a preferred manner). Glue sponge system 100 may be manufactured and provided for sale in a wide variety of sizes and shapes for a wide assortment of applications.

Upon reading this specification, it should be appreciated that, under appropriate circumstances, considering such issues as design preference, user preferences, marketing preferences, cost, structural requirements, available materials, technological advances, etc., other kit contents or arrangements such as, for example, including more or less components, customized parts, different color combinations, parts may be sold separately, etc., may be sufficient.

A method of use may comprise the steps of: step one opening lid 122 of glue-container 120 to access sponge 130 and at least one glue 160; step two contacting an item with sponge 130 and with a portion of at least one glue 160; step three applying at least one glue 160 via sponge 130 to surface 170; and when sufficient glue 160 has been applied step four removing excess glue 160; and step five closing lid 122.

It should be noted that the steps described in the method of use can be carried out in many different orders according to user preference. The use of "step of" should not be interpreted as "step for", in the claims herein and is not intended to invoke the provisions of 35 U.S.C. § 112, 6. Upon reading this specification, it should be appreciated that, under appropriate circumstances, considering such issues as design preference, user preferences, marketing preferences, cost, structural requirements, available materials, technological advances, etc., other methods of use arrangements such as, for example, different orders within above-mentioned list, elimination or addition of certain steps, including or excluding certain maintenance steps, etc., may be sufficient.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A glue sponge system comprising:

a) a glue sponge assembly including:
  i) a glue-container;
  ii) a sponge having:
    a body including:
      a plurality of through-holes; and
      a plurality of through-channels; and
  iii) at least one glue;

b) a kit comprising user-instructions;

f) wherein said plurality of through-holes, and said plurality of through-channels are inter-connected and structured and arranges with said glue-container and with said at least one glue to allow passage of said at least one glue in and out of said body of said sponge;

g) wherein said at least one glue is removably contained within confines of said glue-container, said sponge is insertable into contact with said at least one glue such that said at least one glue is applied to a surface of said sponge;

h) wherein said at least one glue fills at least a portion of said plurality of through-holes and said plurality of through-channels;

i) wherein said at least one glue fills at least a portion of said plurality of through-holes and said plurality of through-channels are jointly structured and arranged with said glue-container for a user to transport to a surface said at least one glue within said sponge from said glue-container;

j) wherein the user is enabled to controllably dispense said at least one glue onto the surface when the user applies via pressure upon said sponge; and k) wherein said plurality of through-holes and said plurality of through-channels of said sponge are structured and arranged with said glue-container and with said at least one glue to controllably reabsorb said at least one glue when the user touch-contacts said plurality of through-holes and said plurality of through-channels of said sponge and applies pressure between said plurality of through-holes and said plurality of through-channels of said sponge and the surface;

l) wherein said plurality of through-holes and said plurality of through-channels of said sponge are structured and arranged such that when the user touch-contacts and applies pressure between said plurality of through-holes and said plurality of through-channels of said sponge that no excess said at least one glue is left on the surface.

2. The glue sponge system of claim 1 wherein said sponge is flexible.

3. The glue sponge system of claim 2 wherein said sponge is porous.

4. The glue sponge system of claim 3 wherein said sponge comprises polyurethane.

5. The glue sponge system of claim 1 wherein said glue-container comprises a lid.

6. The glue sponge system of claim 5 wherein said glue-container comprises at least one hinge.

7. The glue sponge system of claim 6 wherein said lid is hinged in relation to said glue-container such that said glue-container is able to be opened to access said at least one glue.

8. The glue sponge system of claim 6 wherein said lid is hinged in relation to said glue-container such that said glue-container is able to be closed to restrict access said at least one glue.

9. The glue sponge system of claim 6 wherein said lid is hinged in relation to said glue-container such that said glue-container is able to be opened to access said sponge and said at least one glue.

10. The glue sponge system of claim 6 wherein said lid is hinged in relation to said glue-container such that said glue-container is able to be closed to restrict access to said sponge and said at least one glue.

11. The glue sponge system of claim 10 wherein said sponge is structured and arranged with said glue-container to be immersed in said at least one glue for an extended duration said at least one glue being isolated from an ambient-drying environment when said lid is closed.

12. The glue sponge system of claim 1 wherein said sponge does not comprise a pad.

13. The glue sponge system of claim 10 wherein said glue-container with said lid closed resists molding of said at least one glue.

14. The glue sponge system of claim 10 wherein said glue-container with said lid closed resists pre-mature hardening of said at least one glue.

15. The glue sponge system of claim 1 wherein said glue-container comprises plastic such that said glue-container does not react negatively with said at least one glue.

16. The glue sponge system of claim 1 wherein said body of said sponge is soft and deformable.

17. A glue sponge system comprising:

g) a glue sponge assembly including:
  i) a glue-container;
  ii) a sponge having:
    a body including:
      a plurality of through-holes; and
      a plurality of through-channels; and
  iii) at least one glue;

h) a kit comprising user-instructions;

i) wherein said plurality of through-holes, and said plurality of through-channels are inter-connected and structured and arranges with said glue-container and with said at least one glue to allow passage of said at least one glue in and out of said body of said sponge;

j) wherein said at least one glue is removably contained within confines of said glue-container, said sponge is insertable into contact with said at least one glue such that said at least one glue is applied to a surface of said sponge;

k) wherein said at least one glue fills at least a portion of said plurality of through-holes and said plurality of through-channels;

l) wherein said at least one glue fills at least a portion of said plurality of through-holes and said plurality of through-channels are jointly structured and arranged with said glue-container for a user to transport to a surface said at least one glue within said sponge from said glue-container;

m) wherein the user is enabled to controllably dispense said at least one glue onto the surface when the user applies via pressure upon said sponge;

n) wherein said plurality of through-holes and said plurality of through-channels of said sponge are structured and arranged with said glue-container and with said at least one glue to controllably reabsorb said at least one glue when the user touch-contacts said plurality of through-holes and said plurality of through-channels of said sponge and applies pressure between said plurality of through-holes and said plurality of through-channels of said sponge and the surface; and o) wherein said plurality of through-holes and said plurality of through-channels of said sponge are structured and arranged such that when the user touch-contacts and applies pressure between said plurality of through-holes and said plurality of through-channels of said sponge that no excess said at least one glue is left on the surface;

p) wherein said sponge is flexible;

q) wherein said sponge is porous;

r) wherein said sponge comprises polyurethane;

s) wherein said sponge does not comprise a pad;

t) wherein said glue-container comprises a lid;

u) wherein said glue-container comprises at least one hinge;

v) wherein said lid is hinged in relation to said glue-container such that said glue-container is able to be opened to access said at least one glue;

w) wherein said lid is hinged in relation to said glue-container such that said glue-container is able to be closed to restrict access said at least one glue;

x) wherein said lid is hinged in relation to said glue-container such that said glue-container is able to be opened to access said sponge and said at least one glue;

y) wherein said lid is hinged in relation to said glue-container such that said glue-container is able to be closed to restrict access to said sponge and said at least one glue;

z) wherein said sponge is able to be immersed in said at least one glue for an extended duration said at least one glue being isolated from an ambient-drying environment when said lid is closed.

* * * * *